US008191556B2

(12) United States Patent
Betts

(10) Patent No.: US 8,191,556 B2
(45) Date of Patent: Jun. 5, 2012

(54) HAIR-SUPPLEMENTING AND STYLING HAIRPIECE

(75) Inventor: Gael Betts, Lachine (CA)

(73) Assignee: Gael Betts Concepts Inc., Lachine, Quebec (CA)

( * ) Notice: Subject to any disclaimer, the term of this patent is extended or adjusted under 35 U.S.C. 154(b) by 107 days.

(21) Appl. No.: 12/676,045

(22) PCT Filed: Sep. 6, 2007

(86) PCT No.: PCT/CA2007/001579

§ 371 (c)(1), (2), (4) Date: May 13, 2010

(87) PCT Pub. No.: WO2009/030013

PCT Pub. Date: Mar. 12, 2009

(65) Prior Publication Data

US 2010/0236568 A1 Sep. 23, 2010

(51) Int. Cl.
*A41G 5/00* (2006.01)

(52) U.S. Cl. ..... 132/201; 24/563

(58) Field of Classification Search ..... 132/53–56; 24/563, 564, 55–556; D28/92–93, 39–40, D28/42–43

See application file for complete search history.

(56) References Cited

U.S. PATENT DOCUMENTS

| | | | | |
|---|---|---|---|---|
| 338,101 | A * | 3/1886 | Paton | 132/53 |
| 2,620,809 | A * | 12/1952 | Rosen | 132/53 |
| 3,280,826 | A * | 10/1966 | Jenkins | 132/201 |
| 3,495,603 | A * | 2/1970 | Young, Jr. | 132/53 |
| 3,568,899 | A * | 3/1971 | Rosenberg | 223/66 |
| 3,636,962 | A * | 1/1972 | Frackowiak | 132/60 |
| 5,862,814 | A | 1/1999 | Janik et al. | |
| 5,899,211 | A | 5/1999 | Brown | |
| 6,662,806 | B2 | 12/2003 | Nakane et al. | |
| 6,708,696 | B2 | 3/2004 | Ferguson | |
| 2003/0140934 | A1 * | 7/2003 | Sugai et al. | 132/53 |
| 2004/0168696 | A1 * | 9/2004 | Cox | 132/54 |
| 2005/0268929 | A1 | 12/2005 | Frazier | |
| 2007/0221240 | A1 * | 9/2007 | Junsuh Lee | 132/201 |
| 2007/0221244 | A1 * | 9/2007 | Lane et al. | 132/276 |
| 2008/0178902 | A1 * | 7/2008 | Moeszinger | 132/273 |
| 2008/0257369 | A1 * | 10/2008 | Poole | 132/53 |

FOREIGN PATENT DOCUMENTS

WO WO2007/013754 2/2007

* cited by examiner

*Primary Examiner* — Todd Manahan
*Assistant Examiner* — Jennifer Gill
(74) *Attorney, Agent, or Firm* — Norton Rose Canada LLP

(57) ABSTRACT

A hairpiece (35) for supplementing the natural hair of a wearer person (42). The hairpiece comprises a support net (10) formed by interconnected strands (11). The net is shaped to conform with the scalp of the wearer person. A plurality of bands of hair (36) are permanently secured spaced-apart, to the strands (11) of the support net (10). The bands of hair are disposed in a predetermined pattern to conceal the net while maintaining flexibility thereof. Independent attachment spring clips (20) are permanently secured in an upper portion of the support net (10) to removably secure the net in the wearer person's natural hair (43) wherein the net (10) and the attachment spring clips (20) are substantially non-visible in the natural hair to supplement and provide styling to the natural hair.

1 Claim, 7 Drawing Sheets

HAIR-SUPPLEMENTING AND STYLING HAIRPIECE

TECHNICAL FIELD

The present invention relates to a hairpiece for supplementing the natural hair of a wearer or person and wherein the hairpiece is provided with attaching spring clips which facilitate securement thereof while preventing damaging the natural hair and wherein a support form provides for the construction and styling of the hairpiece.

BACKGROUND ART

It is known to enhance the appearance of a person by supplementing natural hair with one or more hair pieces whereby to increase the volume of hair by blending the hairpiece with the natural hair. These hairpieces are usually fabricated from natural hair or synthetic hair. Metal clips are used to attach these hairpieces to the natural hair and a typical example of such hairpiece and attachment clips is described in U.S. Pat. No. 6,708,696. A disadvantage of such hairpiece is that the attachment clips are difficult to secure in a person's hair and they also damage the person's natural hair and cause hair loss particularly in the area where the hairpiece is attached. For a person who has very thin hair and who easily loses hair, this is a major disadvantage as while trying to conceal baldness or thinning hair, the hairpiece causes further loss of the natural hair of the wearer. As shown in that patent, a braided or plaited carrier strand is used to provide attachment of a plurality of hair switches thereto by support rings which are linked through the closed loop of the carrier strand. The formation of these loops causes aggravation to the scalp of the wearer as they are in direct contact and friction with the wearer's scalp. Also, a single strand of hair switches provides for limited cover and body to the natural hair. The carrier strand is attached by a large barrette at each end and these are not concealed by the hairpiece and become visible in the wearer's natural hair.

Attachment devices for known fashioning hairpieces of this type have not proven to adequately secure the hairpiece to permit extended wear, particularly during strenuous activities or during sleeping where the head is in contact with a pillow. Many of the known attachment devices are not readily securable by a wearer person and one has to visit a hair stylist to secure and style the hairpiece. If the hairpiece then becomes detached, the wearer person must remove the entire hairpiece and this normally causes damage to the wearer's hair and no longer provides enhancement.

Many types of artificial hairpieces are known for enhancing the appearance of a wearer and examples thereof can be referenced by U.S. Pat. No. 5,899,211 which shows an artificial hairpiece having an independent extension of synthetic human hair secured at one end to a stretchable, twistable and foldable elastic loop. Other examples of attachment hair clips or barrettes have been provided such as exemplified by U.S. Pat. No. 5,862,814.

There is also a need to provide a hairpiece which will permit the removable attachment of several hair switches or hair strands thereto to provide temporary styling and wherein the support base of the hairpiece can be modified to suit a specific wearer person. There is also a need to provide a hairpiece support form wherein the hairpiece can be temporarily attached thereto to provide combing or styling of the hairpiece or individual hair switches by the user person or by a hair stylist and wherein independent switches can be relocated easily unto the support base or interchanged with other switches, of different color for example, and in a simple effective manner by the wearer person.

DISCLOSURE OF INVENTION

It is a feature of the present invention to provide a hairpiece for supplementing natural hair to the scalp of the wearer person and which substantially overcomes all of the above-mentioned disadvantages of the prior art and provides the mentioned need.

Another feature of the present invention is to provide a hairpiece for supplementing the natural hair of a wearer person and wherein the support base of the hairpiece is a support net which can accommodate a plurality of rows of strands of hair permanently secured thereto and which also permits the removable attachment of hair switches to provide styling in a simple and effective manner.

Another feature of the present invention is to provide a hairpiece for supplementing the natural hair of a wearer person and wherein the hairpiece can be attached and styled by the wearer person and further modified by the wearer person.

Another feature of the present invention is to provide an attaching spring clip for attaching a hairpiece to a wearer person's natural hair in a substantially concealed manner and which is substantially non-damaging to the natural hair.

A still further feature of the present invention is to provide a hairpiece support form for constructing and styling the hairpiece and hair switches and which form can be used by the user person or a hair stylist at a comfortable position.

According to the above features, from a broad aspect, the present invention provides a hairpiece for supplementing the natural hair of a wearer person in a substantially concealed manner. The hairpiece comprises a support net formed by interconnected strands. The net is shaped to conform with a portion of the scalp of the wearer person. A plurality of bands of hair is permanently secured to the strands of the support net. The bands of hair are disposed in a predetermined pattern to conceal the net while maintaining flexibility thereof. Independent attachment means are permanently secured in an upper portion of the support net to removably secure the net in the wearer person's natural hair wherein the net and the attachment means are substantially non-visible in the natural hair to supplement and provide styling to the natural hair.

According to a further broad aspect of the present invention there is provided an attaching spring clip for securing a hairpiece in the natural hair of a wearer person. The spring clip has a pair of spaced-apart attaching legs provided with securement means. The attaching legs are disposed side-by-side in a common plane and define a passage therebetween. A pair of top leafs extend over a top surface of the attaching legs and are formed integral with the attaching legs from a common end thereof. The top leafs are interconnected to one another at a free end thereof by an integrally formed lip portion which is angulated outwardly of the attaching legs to form a mouth opening to facilitate the positioning of a swatch of natural hair, of substantially predetermined volume from a wearer person's scalp, in the clip. A hair biasing leaf is formed integral with one of the top leafs and has a curved section projecting between the attaching legs and in the passage from the common end thereof. The hair biasing leaf has an outwardly curved central portion extending between the pair of top leafs and terminates in a free end disposed between the attaching legs whereby to secure the spring clip to the swatch of hair when positioned under the pair of leafs and over the biasing leaf to secure the support net and bands of hair secured thereto in the natural hair of the wearer person.

According to a still further broad aspect of the present invention there is provided a hairpiece support form for constructing and styling a hairpiece. The support form defines three distinct working surface portions. A first of the surface portions is a curvate rearwardly inclined side surface portion having a wide top end tapering to a narrower bottom end for securing a support net of the hairpiece thereto. A second of the surface portion is a flat top inclined surface portion sloping rearwardly from a marginal edge of the wide top end of the first surface portion to secure hair switches thereto to effect a transformation or maintenance to the hair switches such as dyeing, washing, drying or waving. A third of the surface portions is a vertical inwardly inclined surface portion to provide a storage surface for retaining hair switches in a depending condition at an unobstructing position from a lower edge of the second surface portion. Means is provided to immovably attach the support forms to a stationary object.

BRIEF DESCRIPTION OF THE DRAWINGS

A preferred embodiment of the present invention will now be described with reference to the accompanying drawings in which.

MODES FOR CARRYING OUT THE INVENTION

Figure 1A:
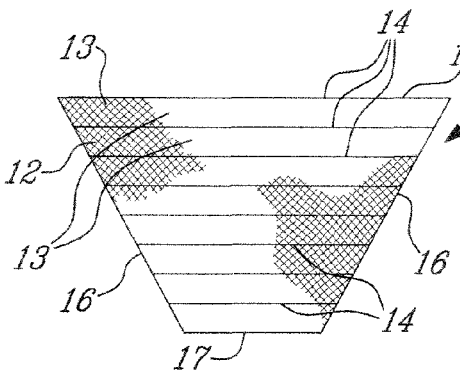
FIG. 1A is a plan view of the hairpiece support net formed by interconnected strands used to fabricate the hairpiece of the present invention.
Figure 1B:
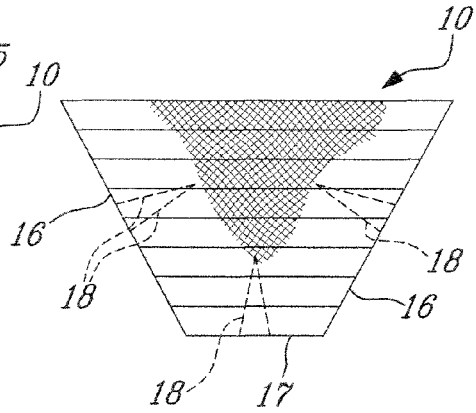
FIG. 1B is a view similar to FIG. 1A but showing the disposition of shaping stitches in the net to impart a curved shape to the net.
Figure 1C:
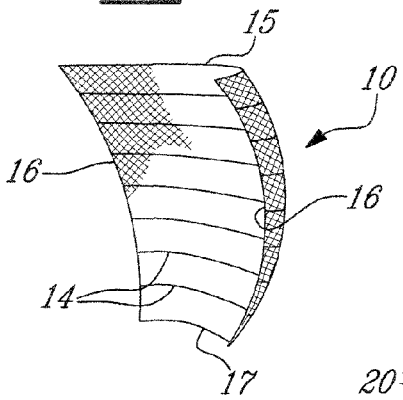
FIG. 1C is a perspective view showing the curved shape of the hairpiece support net.

Referring now to the drawings and more particularly to FIGS. 1A to 1C, there is shown generally at 10 a support net utilized in the construction of the hairpiece of the present invention. The support net 10 is formed by interconnected strands 11 of material, preferably but not exclusively, having a component of elasticity to provide resiliency to the net. These synthetic strands 12 are interconnected in a pattern and define large openings 13 therebetween. Preferably the synthetic material has a coloured pigment to blend with an intended wearer's natural hair color. These strands are also stitched together to provide a plurality of parallel, horizontal and spaced-apart attachment strands 14 to which are permanently secured bands of hair, as will be described later.

As shown in these drawings, the support net has a generally truncated outline defined by a substantially straight upper edge 15, inwardly sloped side edges 16 and a shorter substantially straight lower edge 17. As shown in FIG. 1B, the net is further provided with shaping stitches 18 extending from the side edges 16 and bottom edge 17 whereby to impart a curved shape to the net to provide conformity to the scalp of a wearer person. FIG. 1C illustrates a typical curvature of the net. The net can also be cut between the strands 14 to size the hairpiece.

Figure 2A:
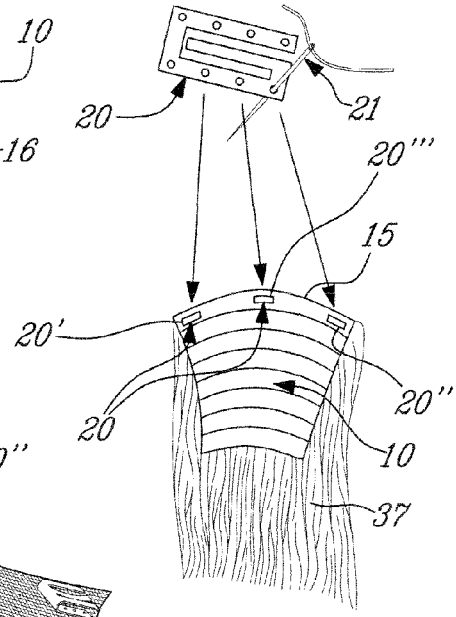
FIG. 2A is an exploded view showing the spring clips attached to a rear upper portion of the support net of FIG. 1C.
Figure 2B:
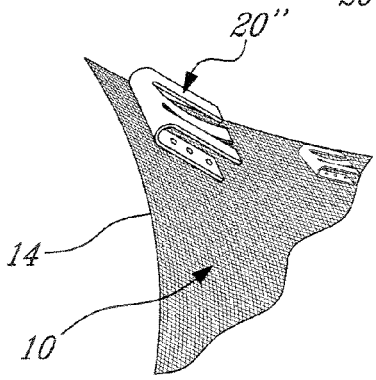
FIG. 2B is a fragmented perspective view showing the attaching spring clip secured to a rear upper corner area of the support net.

With reference now to FIGS. 2A to 3C, there is illustrated the attachment means which are permanently secured to the upper portion of the support net to removably secure the net of the hairpiece 35 (see FIG. 6) in the wearer person's natural hair and wherein the net and the attachment means are substantially non-visible when secured in the natural hair whereby to supplement and provide styling to the natural hair. This attachment means is constituted by an attaching spring clip 20 which is permanently stitched behind the net 10 along the upper edge 15 thereof adjacent each end of the straight upper edge as shown at 20' and 20". A further spring clip 20 is secured intermediate the opposed ends and substantially centrally thereof, to provide additional support, as illustrated by reference numeral 20'''. These spring clips 20 are secured thereto by stitching with a thread and needle 21 as illustrated in FIG. 2A. Other securement means may also be envisaged. If desirable, other spring clips may be secured spaced below the corner clips 20' as illustrated in FIG. 2B.

Figure 3A:
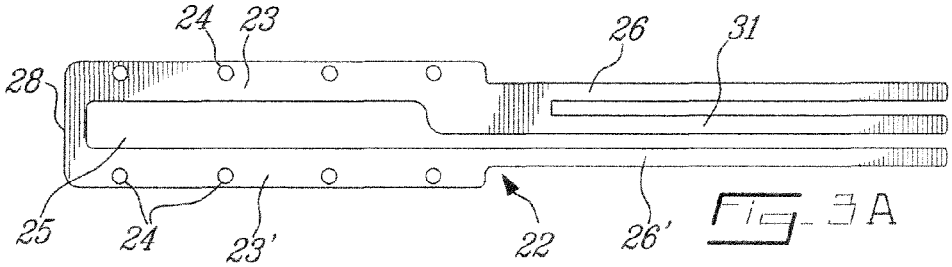
FIG. 3A is a plan view of a metal stamping of spring steel material which forms the attaching spring clip which is used to secure the hairpiece to a wearer's natural hair.
Figure 3B:
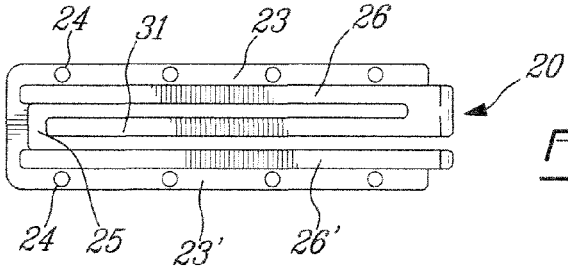
FIG. 3B is a plan view showing the stamping shaped to form the spring clip.
Figure 3C:
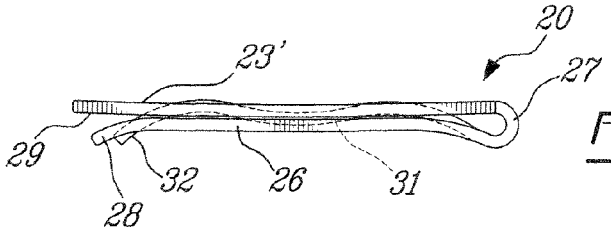
FIG. 3C is a side view of the spring clip and particularly showing the shape of the spring biasing leaf portion of the spring clip.

As shown in FIGS. 3A to 3C, the spring clip 20 is formed from a thin spring steel stamping 22 or any other suitable material having a memory capable of retaining its original shape after flexing. It is, of course, conceivable that this spring clip could be fabricated from plastics material. The attaching spring clip 20 defines a pair of spaced-apart attaching legs 23 and 23' provided with securement means in the form of, spaced-apart, series of holes 24 to receive a needle and thread 21 therethrough for securing the clip to the support net 10. These attaching legs 23 and 23' are disposed side-by-side in a common plane and define a passage 25 therebetween.

Figure 8:
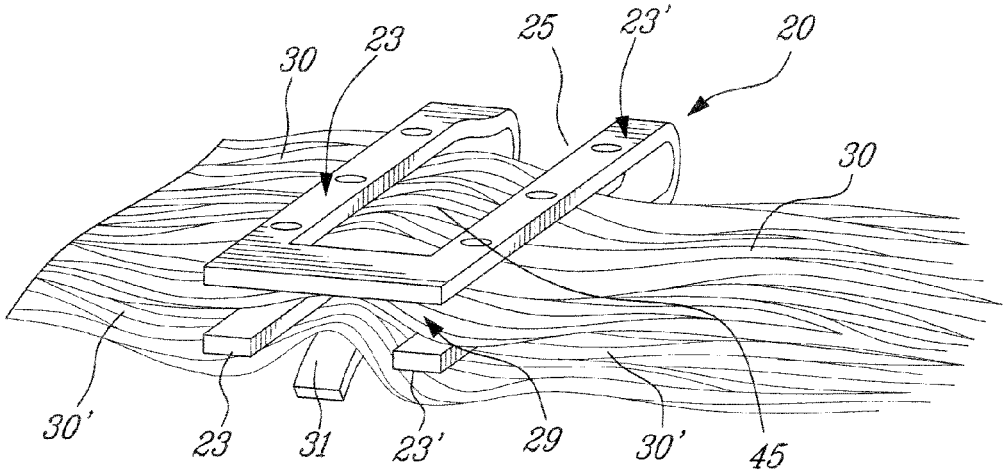
FIG. 8 is a perspective view illustrating the securement of the attaching spring clip to the natural hair of a wearer person.

The spring clip is also provided with a pair of top leafs 26 and 26' extending in substantially parallel relationship over a top surface of the attaching legs 23 and 23' and formed integral with the attaching legs from a common bent end 27 thereof. The attaching legs 23 and 23' are interconnected to one another at a free forward end thereof by an integrally formed lip portion 28 which is curved outwardly of the attaching legs, as better seen from FIG. 3C, whereby to form a smooth mouth entrance 29 to facilitate the positioning of a swatch of natural hair 30, as shown in FIG. 8. The size of the mouth entrance limits the amount of hair that can be positioned into the spring clip as the swatch is formed from gathering the natural hair of a wearer person's scalp.

The spring clip 20 further comprises a hair biasing leaf 31 formed integral with one of the top leafs, herein leaf 26 and has a curved section as shown in phantom line in FIG. 3C which projects between the attaching legs 23 and 23' in the passage 25. This biasing leaf extends from the common end 27 which is bent over the attaching legs 23 and 23' and is provided with an outwardly curved central portion 32 extending between the pair of top leafs 26 and 26' and terminates in a free end disposed between the attaching legs 23 and 23' whereby to secure the spring clip to a swatch or two swatches 30 and 30' of hair, as shown in FIG. 8.

Figure 4:
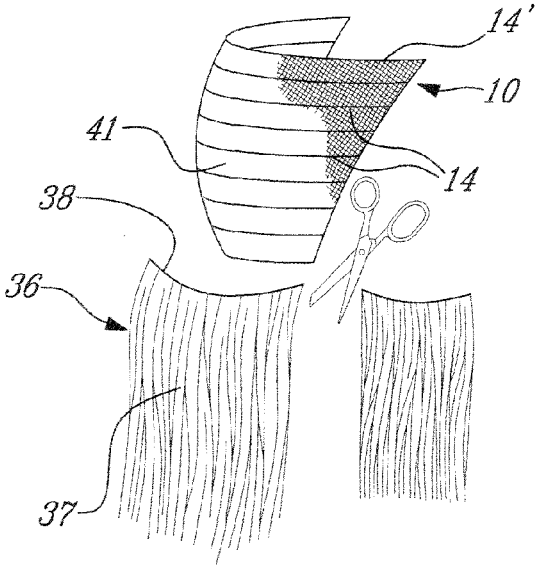
FIG. 4 is an exploded view showing bands of hair to be permanently secured to the support net.
Figure 5:
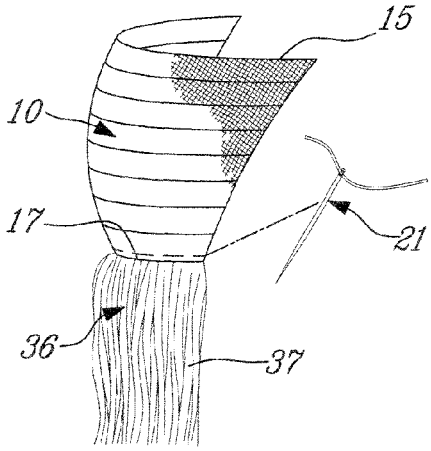
FIG. 5 is a perspective view showing a first band of hair secured to a lower edge of the support net and the manner of doing so.
Figure 6:
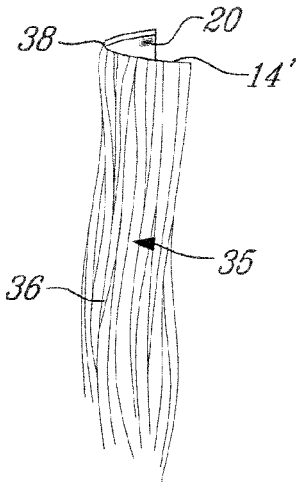
FIG. 6 is a perspective view showing a support net with a plurality of horizontally spaced-apart bands of hair permanently secured thereto to form the hairpiece of the present invention.

Referring now to FIGS. 4 to 6, there is shown the construction of the hairpiece 35 of the present invention. As shown in FIG. 4, bands of hair 36, which comprise natural or synthetic hair 37 secured to an attaching band 38 of fabric or a plaited carrier strand, are cut to length for securement along selected ones of the attaching strands 14 of the support net 10. These bands of hair 36 are permanently stitched to the attaching strands 14 or interconnected strands 12 which form the support net and this is done preferably with the support net mounted on a hairpiece support form 50, as will be described later with reference to FIGS. 15A to 18. The bands of hair 36 are secured to the net starting from the lower edge 17 to the upper edge 15 and such is illustrated in FIG. 5 which shows the needle and thread 21 to effect this permanent attachment. Several of these bands of hair 36 are secured spaced-apart and parallel to one another along selected ones of the attaching strands 14 and to the top edge strand 14', as shown in FIG. 4. These bands of hair 36 are usually of the same length and accordingly when they are secured to the support net spaced-apart, these bands intermingle with one another exposing hair of different lengths to simulate the real hair of the wearer. Of course, the more bands of hair are attached to the net, the thicker is the hairpiece 35 providing more volume to the natural hair of a wearer person. The bands of hair 36 are attached to the attaching strands 14 on the outer surface 41 of the net.

It is also within the ambit of the present invention to provide bands of hair 36 of different widths and also of different color whereby to provide styling to the natural hair of the person. Because these bands of hair are secured spaced-apart in overlying relationship they completely conceal the support net as well as their attachment stitches to the support net.

Figure 7:
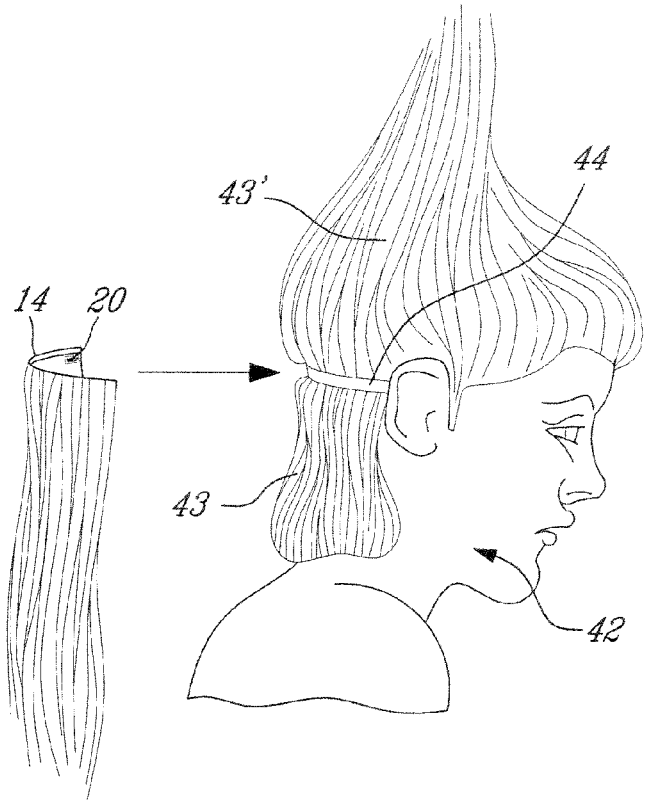
FIG. 7 is an exploded perspective view showing where the hairpiece of the present invention is secured in the natural hair of a wearer person.
Figure 9:
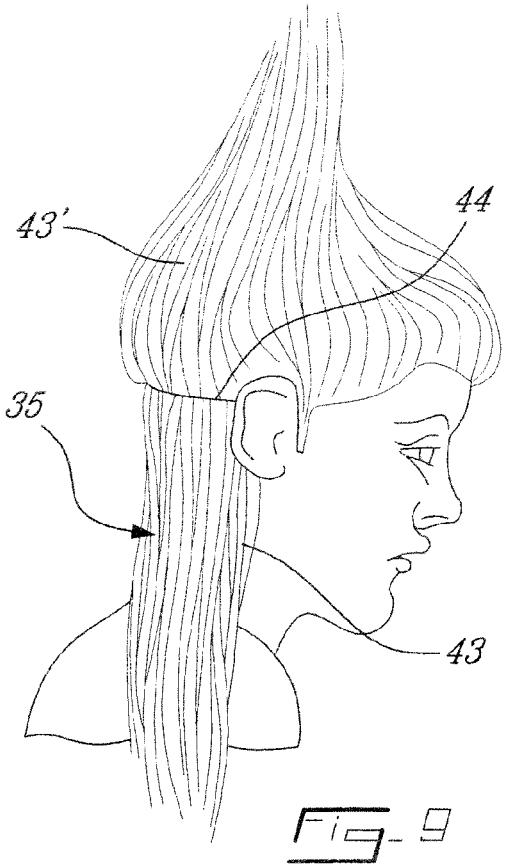
FIG. 9 is a perspective view showing the hairpiece secured to the natural hair of a wearer person by the attaching spring clips.
Figure 10:
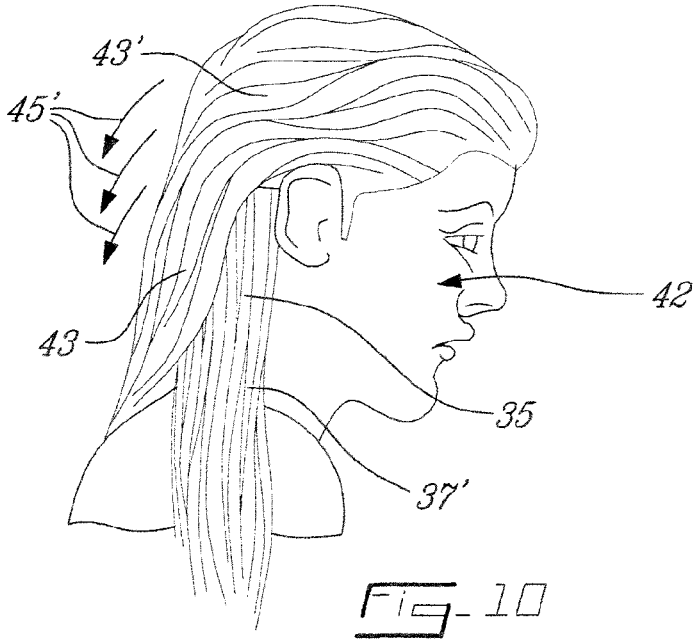
FIG. 10 is a perspective view showing the hairpiece secured in the natural hair of a wearer person in a substantially concealed manner and blending with the natural hair to add volume and styling.

FIGS. 7 to 10 show how the hairpiece 35 of the present invention is secured to the natural hair of a person 42. As shown in FIG. 7, the natural hair 43 of the wearer person 42 is separated to form a hair partition 44 and the top edge 14 of the net is positioned along this partition 44 and secured therealong by the spring clips 20 in a manner as shown in FIG. 8. In order to provide a very secure attachment of the spring clips 20, a swatch of hair 30 is positioned into the mouth opening 29 of the spring clip 20 and pushed thereunder. The spring action of the hair biasing leaf 31 will clamp a portion 45 of the swatch of natural hair 30 into the passage 25 and retain it clamped therein by the pressure of the hair biasing leaf 31 which extends into the passage 25. To provide a more secure attachment a first swatch of hair can also be positioned under the attaching legs 23 and over the hair biasing leaf 31 to provide further immobilization of the spring clip 20, as shown in FIG. 8. FIG. 9 illustrates the hair piece 35 immovably secured to the natural hair 43 of the wearer person 42 along the partition 44 with the clips secured to the hair 43 below the partition 44. After this is done the top portion 43' of the natural hair which was separated is then brought back over the hairpiece 35 in the direction of arrow 45' concealing the top edge thereof and the natural hair is intermingled with the hair from the hairpiece 35. As shown in FIG. 10 the bands of hair 36 are hereinshown as adding extension and volume to the natural hair 43 as illustrated by reference numeral 37'.

Figure 12:
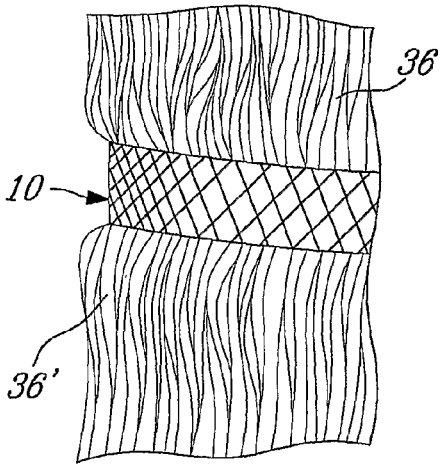
FIG. 12 is a perspective view showing adjacent bands of hair secured to the support net, with two adjacent bands separated to expose the net whereby to secure hair switches thereto by the spring of FIGS. 11B and 11C.
Figure 13:
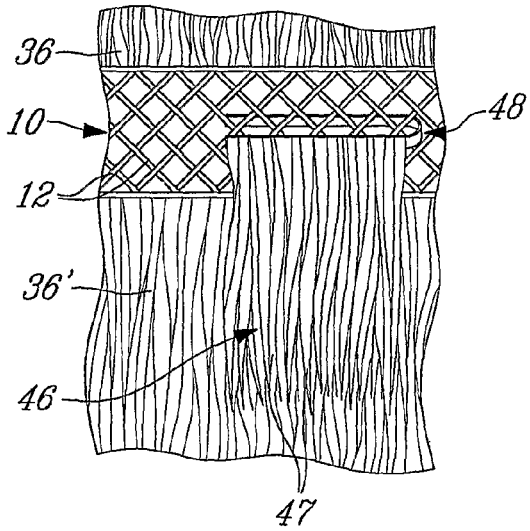
FIG. 13 is a perspective view showing a switch of hair secured to the support net.
Figure 14:
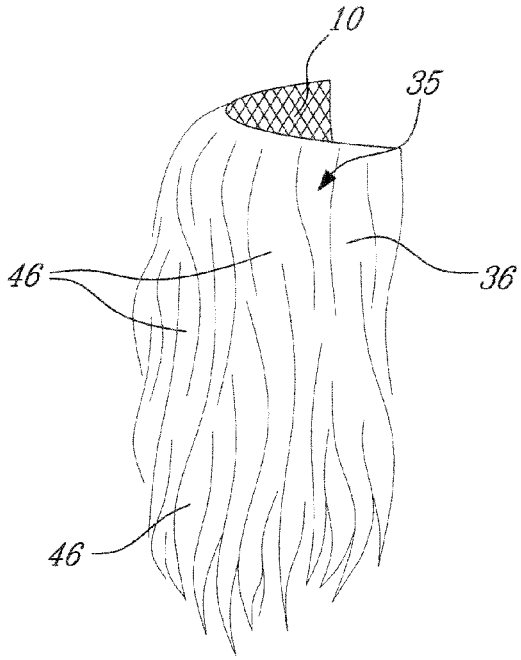
FIG. 14 is a perspective view showing a plurality of switches of hair blended with the bands of hair of the hairpiece of the present invention.

With reference now to FIGS. 12 to 14, there is shown another important advantage of the construction of the hairpiece 35 of the present invention. As hereinshown, the construction of the hairpiece 35 provides for additional hair switches 46 to be removably secured to the support net 10. These additional hair switches 46 are formed from natural or synthetic hair 47 which can be of different color, length or texture whereby to contrast with the plurality of bands of hair 36 permanently secured to the support net 10 and the natural hair of the wearer. The hair switches may also have messages or symbols dyed thereon, such as zodiac signs or the Mongolian script representing words. These signs or scripts can be matched with identical signs or scripts on a piece of apparel worn by the same person. For example a person may want to add a few hair switches of very contrasting color to provide temporary styling or to make a statement such as for a masquerade party, etc. or for any other reason. Such decorative hair switches are illustrated in FIG. 14 wherein the switches contrast significantly with the bands of hair 37.

Figure 11A:
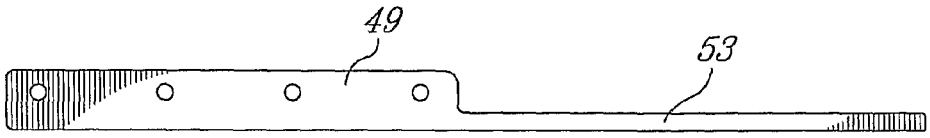
FIG. 11A is a plan view of a stamping of a further clip used to removably attach hair switches to the net.
Figure 11B:
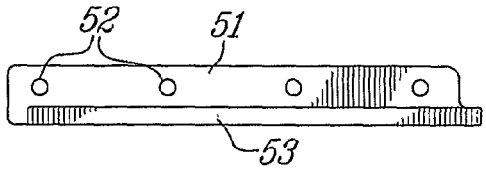
FIG. 11B is a plan view showing the stamping of FIG. 11A shaped to form the clip.
Figure 11C:
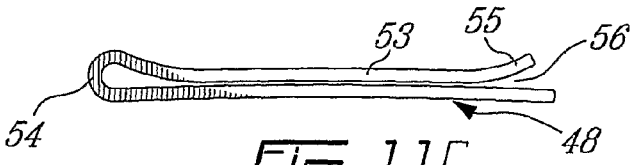
FIG. 11C is a side view of the clip of FIG. 11B.

The hair switches 46 are hereinshown secured to the interconnected strands 12 of the net 10 in a free area between the bands of hair, herein bands 36 and 36'. In order to do so, these switches 46 are secured to a connecting pin 48 which is illustrated in FIGS. 11A to 11C.

The connecting pin 48 is simply formed from a stamping 49 of material capable of retaining its shape when formed, such as that of the spring clip 20 and is comprised of an attaching base 51 provided with holes 52 whereby to stitch the swatch 46 thereto. A top spring leaf 53 is formed integral from one end of the attaching band 49 from a common curved end 54. The free end of the biasing spring leaf 53 is upwardly turned at 55 to define a mouth or entrance opening 56 therebetween. Accordingly, this clip is easily removably secured to the intersecting strands 12 of the support net 10, as shown in FIG. 13. Accordingly, the hairpiece 35 of the present invention further permits the addition and removal of hair switches thereto to provide styling of the hairpiece, as above-mentioned.

Figure 15A:
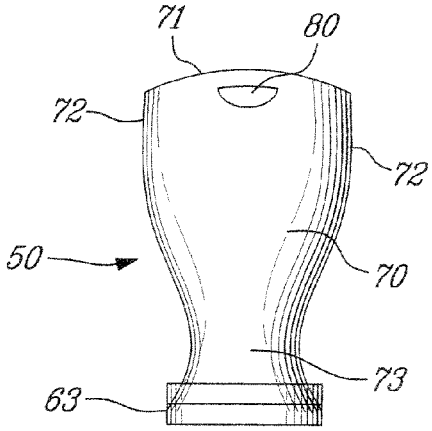
FIGS. 15A to 15C are front, rear and side views, respectively, of a hairpiece support form for constructing and styling the hairpiece of the present invention.
Figure 15B:
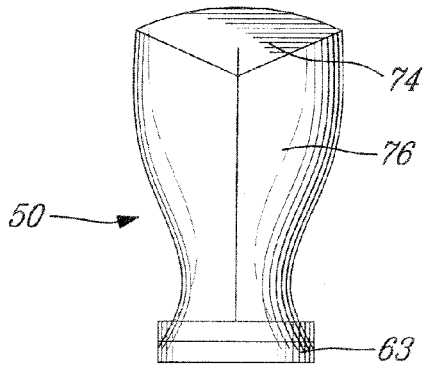
Figure 15C:
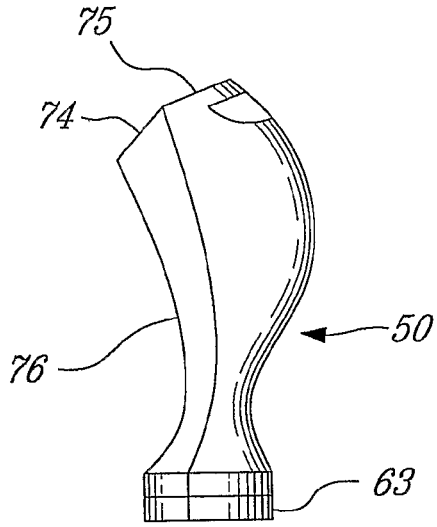
Figure 16:
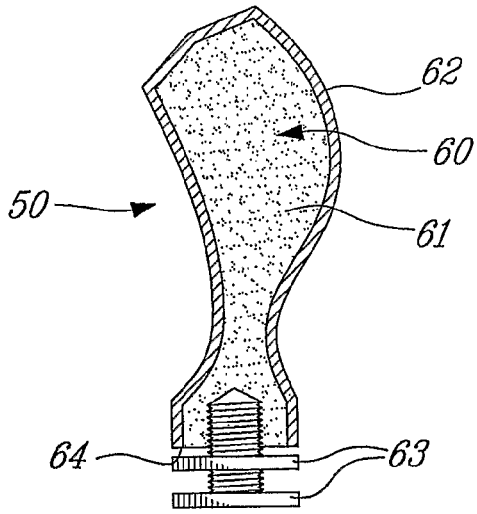
FIG. 16 is a transverse section view of the hairpiece support form showing its construction and its attachment clamp.
Figure 18:
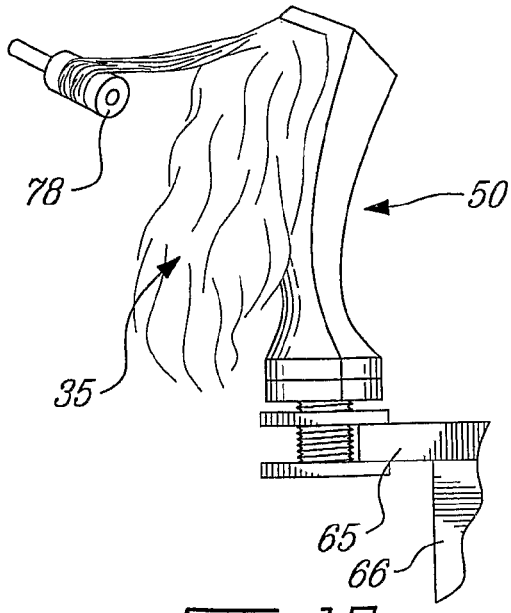
FIG. 18 is a further side view showing the hairpiece support form attached to an article of furniture and wherein a band of hair or portions thereof is being styled with the hairpiece secured to the frontal curvate surface of the support form.

In order to facilitate the construction, washing, dyeing, repair and styling of the hairpiece 35 of the present invention, there is provided a support form 50 as illustrated in FIGS. 15A to 16. The support form 50 is formed from a shaped body 60 of a rigid foam material 61 capable of receiving straight pointed pins therein to removably attach the hairpiece 35 and the support net 10 thereto as well as the hair switches 46 to provide styling thereof or dyeing of the switches. As shown in FIG. 16, the foam material 61 is covered with an outer coating of polymeric material 62 and which is capable of resisting to dye chemicals used to color hair secured to the support form. A clamping device 63 is permanently secured to the lower end 64 of the support form 50 and constitutes a means to immovably attach the support form to an object such as the ledge 65 of the article of furniture 66, as illustrated in FIG. 18.

As shown in FIGS. 15A to 15C, the support form 50 defines three distinct working surface portions. A first of these surface portions 70 is a curvate rearwardly inclined side surface portion, as better shown in FIG. 15C having a wide top end 71 to bring along its opposed side 72 to a narrower bottom end 73. This first surface portion 70 is adapted for securing the support net 10 thereto and is shaped similar to a rear portion of a human head. A finger gripping indentation 80 is provided adjacent the marginal edge 75 to provide a finger grip to grasp the support form 50.

Figure 17:
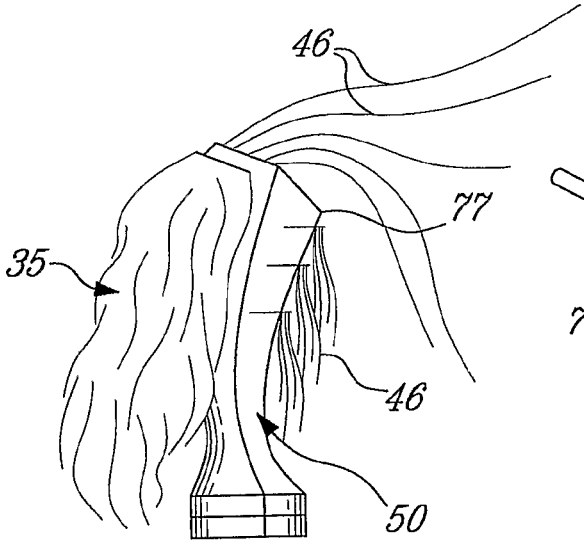
FIG. 17 is a side view showing the utility of the hairpiece support form.

The support form 50 also defines a second surface portion which is a flat top inclined surface portion 74 which slopes rearwardly from a marginal edge 75 of the wide top end 71 of the first surface portion 70 to secure hair switches 46 thereto as illustrated in FIG. 17. This permits the wearer person or a hair stylist to effect a transformation to the switches such as dyeing or imparting waves to the hair of the switches.

A third of the surface portion is constituted by a vertical inwardly inclined surface 76 which provides for a storage or retention surface for retaining hair switches 46, as illustrated in FIG. 17, in a depending condition and at a non-obstructing position from a lower edge 77 of the second surface portion 74 whereby switches which have been dyed can be left in a depending form to dry. They are also disposed in such a position as to permit a hair dryer to impart a drying hair stream thereto. Accordingly, the support form 50 is designed to permit the wearer person or a hair stylist to provide a working station for the transformation of the hairpiece and switches and also to construct the hairpiece 35 onto the form, or simply for storage when not in use. The angles of the surface portions 70, 74 and 76 have been selected to provide good visibility and comfortable disposition of the hairpiece and its material as well as switches when the form is mounted at a comfortable working height. FIG. 18 illustrates such transformation wherein some strands of hair or a switch of hair from the hairpiece 35 is being curled with a curling brush 78 to provide a transformation with the support form 50 secured to the ledge 65 of a table 66 at a comfortable height.

Summarizing the present invention, it comprises as well the method of constructing the hairpiece which includes the steps of forming a hair net with interconnected strands to delineate a truncated outline to the net and shaping the hair net to impart the rounded shape as illustrated in FIG. 1C. A plurality of bands of hair 36 are permanently secured to the hair support net in spaced-apart horizontal rows starting from a bottom end of the net to the top end thereof, at selected intervals. Spring clips 20 are then secured to at least opposed ends of the top edge of the support net 10 and in a rear surface of the net.

The hairpiece of the present invention is then secured to the natural hair of a wearer person by forming a hair partition, such as the hair partition 44 illustrated in FIG. 7, in the natural hair of the wearer person. The top edge of the hairpiece 35 with the securement spring clips is secured to swatches of natural hair under the top edge of the support net with the upper edge of the net held taut. To provide additional styling further switches of hair may be detachably secured to the net between the bands of hair 36 which are permanently secured to the net.

To provide hair enhancing treatment or storage of the hairpiece 35 and the switches 46 of hair, the hairpiece and switches are removed from the wearer person's hair and placed onto the support form 50, as illustrated in FIGS. 15A to 18.

It is within the ambit of the present invention to cover any obvious modifications of the preferred embodiment described herein, provided such modifications fall within the scope of the appended claims.

The invention claimed is:

1. A method of constructing a hairpiece for supplementing natural hair of a person in a substantially concealed manner, said hairpiece being comprised of a support net formed by interconnected strands, said support net being shaped to conform with a portion of the scalp of the person; said support net having a generally truncated outline defined by a substantially straight upper edge, inwardly sloped side edges and a shorter substantially straight lower edge; said interconnected strands being formed of synthetic material, shaping stitches in said support net to impart a curved shape in said support net, a plurality of bands of hair are permanently secured to said strands of said support net, said bands of hair being disposed in a predetermined pattern to conceal said support net while maintaining flexibility thereof; attaching spring clips are permanently secured in an upper portion of said support net to removably secure said support net in the person's natural hair wherein said net and said attaching spring clips are substantially non-visible in said natural hair to supplement and provide styling to said natural hair, said method comprising the steps of i) forming said support net with said interconnected strands to delineate said truncated outline;

ii) shaping said support net to impart said curved shape to said support net;

iii) securing said plurality of bands of hair to said support net in spaced-apart rows;

iv) securing independent hair switches to said support net, said hair switches blending with said bands of hair and said natural hair;

v) securing an attaching spring clip to said strands at at least opposed ends of a top edge of said support net and in a rear surface thereof;

vi) securing said support net to the natural hair of a wearer person by forming a hair partition in said natural hair and positioning said top edge of said support net along said hair partition and securing each said spring clip to a swatch of said natural hair under said top edge of said support net with said upper edge held taut, and enhancing said hairpiece by:

vii) detaching said support net and bands of hair secured thereto from said natural hair of said wearer person;

viii) temporarily securing said support net and bands of hair to curvate rearwardly inclined side surface portion of a hairpiece support form;

ix) effecting a hair enhancing treatment to said bands of hair, and temporarily securing one or more of said hair switches to a top inclined surface portion of said support form, effecting a treatment to said switches as desired, and removably securing said switches to said support net at predetermined locations between said bands of hair.

* * * * *